US006119270A

United States Patent [19]

Chou

[11] Patent Number: 6,119,270

[45] Date of Patent: Sep. 19, 2000

[54] GARMENT

[76] Inventor: Chao-Mu Chou, 4F, No. 14, Alley 11, Lane 123, Sec. 3, Jen Ai Road, Taipei, Taiwan

[21] Appl. No.: 09/382,651

[22] Filed: Aug. 25, 1999

[30] Foreign Application Priority Data

Sep. 22, 1998 [TW] Taiwan ..... 87215691

[51] Int. Cl.[7] ..... A41D 1/02

[52] U.S. Cl. ..... 2/108; 2/69; 2/93; 2/125

[58] Field of Search ..... 2/108, 79, 85, 2/93, 125, 126, 115, 80, 83, 114, 61.5, 69

[56] References Cited

U.S. PATENT DOCUMENTS

| | | | |
|---|---|---|---|
| 2,391,535 | 12/1945 | Zelano | 2/93 |
| 3,771,169 | 11/1973 | Edmund | 2/79 |
| 4,122,553 | 10/1978 | Pitanen | 2/102 |
| 5,105,477 | 4/1992 | Golde | 2/93 |
| 5,182,812 | 2/1993 | Goldsby | 2/79 |
| 5,628,064 | 5/1997 | Chung | 2/70 |
| 5,642,526 | 7/1997 | Thompson | 2/79 |
| 5,717,999 | 2/1998 | Lurry | 2/69 |
| 5,718,000 | 2/1998 | Ost et al. | 2/69 |

FOREIGN PATENT DOCUMENTS

| | | | |
|---|---|---|---|
| 2641215 | 3/1978 | Germany | 2/69 |

*Primary Examiner*—John J. Calvert
*Assistant Examiner*—Tejash Patel
*Attorney, Agent, or Firm*—Dougherty & Troxell

[57] ABSTRACT

A garment, which includes a left front panel having an inner lateral side and an outer lateral side and a bottom side, a right front panel, the right front panel having an inner lateral side detachably fastened to the inner lateral side of the left front panel, an outer lateral side, and a bottom side, a left sleeve, a right sleeve, and a back panel fastened to the left sleeve and the right sleeve and the outer lateral side of the left front panel and the outer lateral side of the right front panel by stitches, wherein at least one closure is fastened to one of the left sleeve and the right sleeve and one of the left front panel and the right front panel, each extended from the cuff of the left sleeve or right sleeve to the armpit area at the left front panel or right front panel and then obliquely extended from the arm pit area to the bottom side of the left front panel or right front panel.

5 Claims, 2 Drawing Sheets

GARMENT

BACKGROUND OF THE INVENTION

The present invention relates to garments, and more specifically to such a garment that can easily be put on/taken off from the user and, that can be used as a trench coat or patient clothes.

People may wear different clothes in different times for different purposes. For example, a person may wear a ceremonial dress when participating a party, a sports wear when playing a sports game, a trench coat when riding a bicycle, or a patient clothes when living in a hospital to receive a medical treatment. A poncho, trench coat or patient clothes must be designed to be conveniently taken off from the body. These clothes commonly have a zip fastener or buttons at the front side for joining two front panels. However, this design of clothes is still not convenient to patients. Further, during a cold day, people tend to put the hands in pockets at the pants or skirt under the overcoat. However, before putting the hands in the pockets at the pants or skirt, the bottom of the overcoat must be lifted.

Various garments and clothes that can easily be put on the body or taken off from the body are well known. Exemplars are seen in U.S. Pat. Nos. 5,392,466; 5,553,323; 5,564,126, which were invented by the present inventor.

SUMMARY OF THE INVENTION

The present invention has been accomplished under the circumstances in view. According to the present invention, at least one, for example, two closures are bilaterally fastened to the two sleeves and the two front panels of the garment. Each closure extends from the cuff of the left or right sleeve to the armpit area at the left or right front panel, and then extends obliquely extended from the arm pit area to the bottom side of the left or right front panel. By separating the upper end of the closure at the left or right sleeve, the left or right hand is allowed to be moved freely outside the left or right sleeve. By separating the bottom end of the closure at the left or right sleeve, the left or right hand can conveniently be inserted into an inner pocket at the inside of the left or right front panel.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
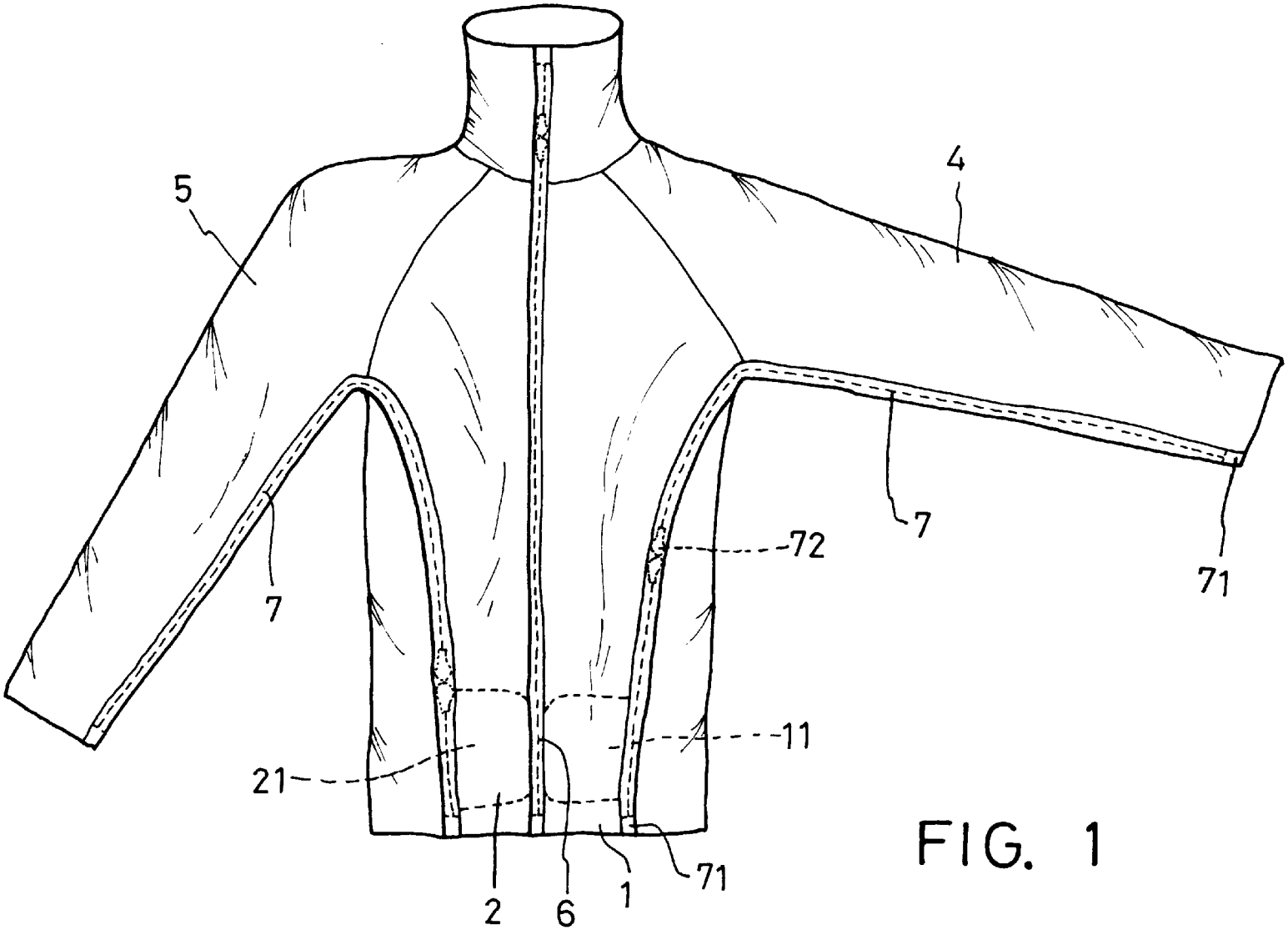
FIG. 1 is a perspective view of a garment according to the present invention.
Figure 2:
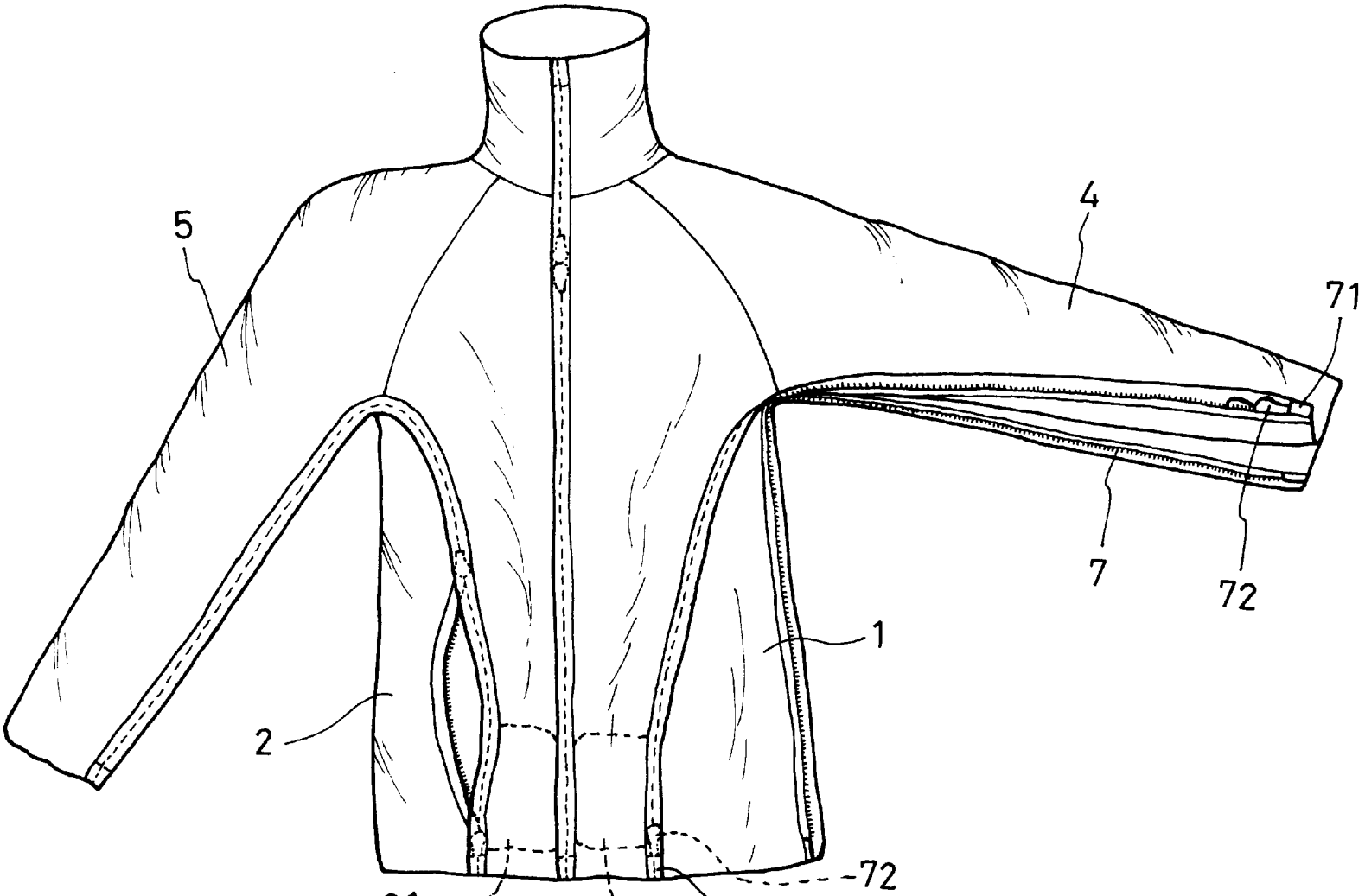
FIG. 2 illustrates one application example of the present invention.

Referring to FIGS. 1 and 2, a garment is shown comprising a left front panel 1, a right front panel 2, a back panel 3 (not shown), a left sleeve 4, and a right sleeve 5 respectively fastened to one another by stitches. The left front panel 1 and the right front panel 2 have a respective inner lateral side detachably fastened to each other by a closure 6, and a respective outer lateral side respectively connected to the back panel 3 and the left sleeve 4 or right sleeve 5. The closure 6 can be a zip fastener, or buttons. A closure 7 is fastened to the sleeve 4 or 5 and the front panel 1 or 2. The closure extends longitudinally from the cuff of the sleeve 4 or 5 to the armpit at the front panel 1 or 2, and then extends slightly obliquely from the armpit to the bottom of the front panel 1 or 2.

The closure 7 is preferably a zip fastener having at least one for example two distal ends terminating in a respective detachable bottom-end piece 71. The zip fastener 7 is closed/separated by two slides 72. By sliding either of the slides 72, the zip fastener 7 is closed/separated from either end.

As illustrated in FIG. 1, two closures (zip fasteners) 7 are bilaterally provided between the sleeves 4 and 5 and the front panels 1 and 2. When the closures (zip fasteners) 7 are separated, the garment is used as a poncho with a hole in the middle for the head. When the closures 6 and 7 are separated, the garment is fully opened, and can easily be taken off from the body.

As an alternate form of the present invention, the inner lateral side of the left front panel 1 can be detachably fastened to the inner lateral side of the right front panel 2 by a closure 6, the outer lateral side of the right front panel 2 and the outer lateral side of the left front panel 1 are respectively fastened to the back panel 3 by stitches, and a closure 7 is fastened to the right sleeve 5 and the right front panel 2. This design is suitable for patients. By means of separating the closure 7 to the desired location, for example, the armpit, the patient's right hand can be freely moved outside the right sleeve 5 to receive a medical treatment, for example, a blood pressure measuring operation. Because the heart is at the left side of the body, most patients let the left hand receive a drip infusion, and keep the right hand free for movement. When receiving a drip infusion, the tubing of the drip infusion apparatus can be inserted through the left sleeve 4. When measuring the patient's body temperature, the two slides 72 of the closure 7 can be spaced from each other with an opening left therebetween corresponding to the armpit at the left arm, so that the clinical thermometer can be directly inserted in the armpit at the left arm. When putting the garment on the patient, the garment is fully opened, then the patient's right arm is put on the right sleeve 5, the patient's left arm and the tubing of the drip infusion apparatus are put on the left sleeve 4, and then the closures 6 and 7 are closed.

When a patient wears the garment, the closure 7 at the sleeve 4 or 5 is normally kept from sight without affecting the nice looking of the garment. Further, the lower end of each closure 7 (the section of each closure 7 at the respective front panel 1 or 2) can be separated, so that the patient can conveniently insert the hands into respective inner pockets 11 and 21 at the inside of the front panels 1 and 2 to pick up things, or to keep the hands warm.

It is to be understood that the drawings are designed for purposes of illustration only, and are not intended for use as a definition of the limits and scope of the invention disclosed. For example, the garment can be made in the form of a poncho, trench coat, patient clothes, etc.

What the invention claimed is:

1. A garment comprising a left front panel having an inner lateral side, an outer lateral side and a bottom side, a right front panel, said right front panel having an inner lateral side detachably fastened to the inner lateral side of said left front panel, an outer lateral side, and a bottom side, a left sleeve, a right sleeve, and a back panel fastened to said left sleeve, said right sleeve, the outer lateral side of said left front panel and the outer lateral side of said right front panel by stitches, wherein at least one closure is fastened to one of said left sleeve and said right sleeve and one of said left front panel and said right front panel, each extended from a cuff of said left sleeve or right sleeve to an armpit area at said left front panel or right front panel and then obliquely extended from the armpit area to the bottom side of said left front panel or right front panel.

2. The garment of claim 1 wherein said at least one closure each has at least one detachable bottom-end piece at one of two distal ends thereof.

3. The garment of claim 2 wherein said at least one closure each has two detachable bottom-end pieces at two distal ends thereof.

4. The garment of claim 2 wherein said at least one closure each is comprised of a zip fastener having two slides.

5. The garment of claim 1 wherein at least one of said left front panel and said right front panel has an inner pocket on the inside adjacent to said at least one closure.

* * * * *